US006918552B2

(12) United States Patent
Jelinek et al.

(10) Patent No.: US 6,918,552 B2
(45) **Date of Patent: *Jul. 19, 2005**

(54) SYSTEM AND METHOD FOR PRODUCING A CONTINUOUS FABRIC STRIP FOR USE IN MANUFACTURING PAINT ROLLER COVERS

(75) Inventors: Dale C. Jelinek, Janesville, WI (US); Marcus I. Skildum, Janesville, WI (US)

(73) Assignee: Monterey Mills, Janesville, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/770,161

(22) Filed: Feb. 2, 2004

(65) Prior Publication Data

US 2004/0149845 A1 Aug. 5, 2004

Related U.S. Application Data

(63) Continuation of application No. 10/283,853, filed on Oct. 30, 2002, now Pat. No. 6,685,121, which is a continuation of application No. 09/864,969, filed on May 24, 2001, now Pat. No. 6,502,779.

(51) Int. Cl.[7] ..... B65H 18/28
(52) U.S. Cl. ..... 242/178; 242/471
(58) Field of Search ..... 242/471, 552, 242/556.1, 413.4, 413.5, 413.6, 178, 176, 159; 206/389, 417

(56) References Cited

U.S. PATENT DOCUMENTS

| | | | |
|---|---|---|---|
| 2,298,682 | A | 10/1942 | Dahlstrom |
| 2,669,742 | A | 2/1954 | Coughlan |
| 2,984,425 | A | 5/1961 | Thayer |
| 3,322,363 | A | 5/1967 | Davidson et al. |
| 3,721,397 | A | 3/1973 | Hori et al. |

(Continued)

FOREIGN PATENT DOCUMENTS

| | | |
|---|---|---|
| JP | 62-74882 | 6/1987 |
| JP | 4-217553 | 7/1992 |

OTHER PUBLICATIONS

Roller Fabrics Website. www.rollerfabrics.com/about.html. "Roller Fabrics: 50+ year Old Silver Knit Pile Manufacturer. Supplies Paint Roller, Automotive . . . ".
Paint Store Website. www.paintstore.com/archives/305.html. "Covers Uncovered" by John Sanger.
Photograph 1. 2004.
Photograph 2. 2004.
Photograph 3. 2004.
Photograph 4. 2004.
Photograph 5. 2004.
Photograph 6. 2004.

*Primary Examiner*—John M. Jillions
(74) *Attorney, Agent, or Firm*—Reinhart Boerner Van Deuren s.c.

(57) ABSTRACT

A roll of knitted pile fabric is disclosed including an extended length fabric strip made from a plurality of seamed standard lengths of the fabric, the extended length fabric strip being substantially spirally wound upon a hollow core with consecutive windings of the extended length fabric strip being located close adjacent each other, and with consecutive rows of the extended length fabric strip overlaying each other on the hollow core. In the preferred embodiment, the standard length fabric strips are joined together at their respective contiguous ends using a small strip of heat-activated seaming tape. The extended length fabric strip is suitable for use in the manufacture of paint roller covers.

21 Claims, 11 Drawing Sheets

U.S. PATENT DOCUMENTS

| | | | |
|---|---|---|---|
| 4,093,146 | A | 6/1978 | Haley |
| 4,401,504 | A | 8/1983 | Kobayashi |
| 4,482,100 | A | 11/1984 | Yoshida |
| 4,545,549 | A | 10/1985 | Rundo |
| 4,634,070 | A | 1/1987 | Looper |
| 4,645,554 | A | 2/1987 | Wyser |
| 4,676,448 | A | 6/1987 | Kofler |
| 4,759,512 | A | 7/1988 | Gaiser |
| 5,169,083 | A | 12/1992 | Sannohe et al. |
| 5,516,058 | A | 5/1996 | Omokawa et al. |
| 5,614,047 | A | 3/1997 | Garcia |
| RE35,526 | E | 6/1997 | Alvarez Garcia |
| 5,694,688 | A | 12/1997 | Musch et al. |
| 6,007,016 | A | 12/1999 | Helton |

SYSTEM AND METHOD FOR PRODUCING A CONTINUOUS FABRIC STRIP FOR USE IN MANUFACTURING PAINT ROLLER COVERS

IDENTIFICATION OF RELATED APPLICATIONS

This patent application is a continuation of U.S. patent application Ser. No. 10/283,853, filed on Oct. 30, 2002, now U.S. Pat. No. 6,685,121, entitled "System and Method for Producing a Continuous Fabric Strip for Use in Manufacturing Paint Roller Covers," the entirety of which is incorporated herein by reference, which is in turn a continuation of U.S. patent application Ser. No. 09/864,969, filed on May 24, 2001, now U.S. Pat. No. 6,502,779, entitled "System and Method for Producing a Continuous Fabric Strip for Use in Manufacturing Paint Roller Covers," the entirety of which is incorporated herein by reference.

BACKGROUND OF THE INVENTION

Field of the Invention

The present invention relates generally to a system and method for producing a spool having a continuous fabric strip wound thereupon, and more particularly to a system and method for producing an extended length strip of pile fabric made from a plurality of seamed standard lengths of the pile fabric, the extended length strip of pile fabric being spirally wound upon a hollow core with consecutive windings of the fabric strip being located close adjacent each other, and with consecutive rows of the fabric strip overlaying each other on the hollow core.

The two inventions which have had the greatest impact on paint application are the invention of the paint roller in the 1930's and the development of water-based paint in the late 1940's. While water-based paints are easy to mix, apply, and clean up, there is little doubt that the paint roller has been the greatest single time saving factor in the paint application process, allowing large surfaces to be painted with a uniform coat of paint quickly and easily. Typically, paint rollers are comprised of two components, namely a handle assembly and a paint roller cover for installation onto the handle assembly.

The handle assembly consists of a grip member having a generally L-shaped metal frame extending therefrom, with the free end of the metal frame having a rotatable support for a pain roller cover mounted thereon. The paint roller cover consists of a thin, hollow cylindrical core which fits upon the rotatable support of the handle, with a plush fabric being secured to the outer diameter of the paint roller cover. The core may be made of either cardboard or plastic material, with which material is used for the core generally being determined based upon the selling price of the paint roller cover. The plush fabric is typically applied as a strip which is spirally wound onto the outer surface of the core, and which may be secured either by using adhesive or by the application of heat during the manufacturing process to bond the fabric strip to the core. In either event, adjacent windings of the fabric strip are located close adjacent each other, to provide the appearance of a single continuous plush fabric covering on the core.

Typically, the plush fabric is a dense knitted pile fabric, which is manufactured in segments which are approximately sixty inches wide by thirty to fifty yards long (depending on fabric weight). As these segments are taken off the manufacturing line, they are slit into two and seven-eighths inch wide strips, which are wound into rolls which are then provided to the paint roller cover manufacturer for use in the manufacture of paint roller covers. Each of the sixty inches wide by thirty to fifty yard long segments will yield twenty such rolls, with each roll being thirty to fifty yards long.

The knitted pile fabric may be knitted from natural fibers such as wool or mohair, synthetic fibers such as polyester, acrylic, nylon, or rayon, or from a blend of natural and synthetic fibers. The knitting is typically performed on a circular sliver knitting machine, which produces a tubular knitted fabric backing with a knit-in pile. The backing is typically made of synthetic yarns, with the pile being made of a desired natural or synthetic fiber, or a blend of different fibers. The tubular knitted pile fabric is then slit to produce an extended segment of fabric which is typically sixty inches wide by thirty to fifty yards long, as mentioned above.

The knitted pile fabric segment is then tensioned longitudinally and transversely, and is then back coated (on the non-pile side of the backing) with a stabilized coating composition such as a clear acrylic polymer. The coating composition which is coated onto the non-pile side of the backing is then processed, typically by heat, to produce such a stabilized knitted pile fabric segment. The heating operation dries and bonds the coating composition to the backing, producing a fabric which is essentially lint-free.

The coated knitted pile fabric can then be subjected to a shearing operation to achieve a uniform pile length, with the sheared fibers being removed by vacuum, electrostatically, or by any other known removal technique. The pile density, the nap length, and the stiffness of the fibers are varied based upon customer specifications and the particular characteristics of the paint roller cover which are desired.

The coated, sheared knitted pile fabric segment is then slit into a plurality of two and seven-eighths inch wide knitted pile fabric strips, of which there are typically twenty for a sixty inch wide fabric segment. The knitted pile fabric strips are rolled onto a core to produce twenty rolls of knitted pile fabric strips, each of which is thirty to fifty yards long. In the past, these eighty foot long rolls of knitted pile fabric strips would then be shipped to a paint roller cover manufacturer.

The paint roller cover manufacturer manufactures the paint roller covers by using a hollow cylindrical core made of cardboard or thermoplastic material which has the knitted pile fabric strip spirally wound around the core. The knitted pile fabric strip may be retained on the core using either an adhesive or by thermally bonding the knitted pile fabric strip in place on a thermoplastic cover. For examples of this manufacturing process see U.S. Pat. No. 5,694,688, to Musch et al., or U.S. Pat. No. 5,614,047, to Garcia.

It will be appreciated by those knowledgeable about the manufacturing of paint roller covers that one of the biggest inefficiencies in the manufacturing process is the necessity to halt the winding operation whenever the end of a segment of the knitted pile fabric strip is reached. A new knitted pile fabric strip must then be either started on the winding machine, or the new knitted pile fabric strip must be seamed to the old knitted pile fabric strip. This takes substantial manual labor, and increased the paint roller cover manufacturer's cost of manufacturing.

It is accordingly the primary objective of the present invention that it provide both a system and a method for the manufacture of knitted pile fabric strips of a substantially extended length for use by paint roller cover manufacturers in their manufacture of paint roller covers. It is a closely related objective that the extended length knitted pile fabric strips of the present invention function as if they were one complete knitted pile fabric strip rather than a knitted pile fabric strip assembled from a plurality of shorter knitted pile fabric strips. It is also a primary objective that the extended length knitted pile fabric strips of the present invention are supplied in an easy to use configuration which the paint roller cover manufacturers will find to be convenient in their manufacture of paint roller covers, without requiring any revision of their manufacturing processes or a substantial investment in new equipment.

It is an additional objective that the extended length knitted pile fabric strips of the present invention be manufacturable at minimal additional cost as compared to knitted pile fabric strips of conventional length. It is a further objective of the extended length knitted pile fabric strips of the present invention that they be packaged in a configuration which is convenient to ship despite the extended length of the extended length knitted pile fabric strips. It is a related objective of the present invention that the form in which the extended length knitted pile fabric strips of the present invention is stored for shipment be as compact as possible to thereby require the minimum volume of packaging for shipment.

The apparatus used by the system and method of the present invention to manufacture the extended length knitted pile fabric strips must also be of construction which is both durable and long lasting, and it should also require little or no maintenance to be provided by the user throughout its operating lifetime. In order to maximize the market appeal of the extended length knitted pile fabric strips of the present invention, the system of the present invention used to manufacture them and its cost of operation must both be as inexpensive as possible to thereby afford the knitted pile fabric strips of the present invention the broadest possible market. Finally, it is also an objective that all of the aforesaid advantages and objectives of the extended length knitted pile fabric strips of the present invention be achieved without incurring any substantial relative disadvantage.

SUMMARY OF THE INVENTION

The disadvantages and limitations of the background art discussed above are overcome by the present invention. With this invention, a plurality of rolls of standard knitted pile fabric strips are joined together at their respective contiguous ends. Each of the seaming operations is performed at a seaming station using a small strip of heat-activated seaming tape which is placed over the seam on the back sides of the contiguous knitted pile fabric strips, and then heat and pressure are applied by the seaming station to create the seam. The extended length knitted pile fabric strip is then packaged appropriately for shipping into a compact, efficient configuration which is easy to ship and easy to use.

Typically, the plush fabric is a dense knitted pile fabric, which is manufactured in segments which are approximately sixty inches wide by thirty to fifty yards long. As these segments are taken off the manufacturing line, they are slit into two and seven-eighths inch wide strips, which are wound into rolls which are then provided to the paint roller cover manufacturer for use in the manufacture of paint roller covers. Each of the sixty inches wide by thirty to fifty yards long segments will yield twenty such rolls, with each roll being thirty to fifty yards long. The rolls may be temporarily stored in a segmented temporary storage container or on a dispensing stand.

The path of the knitted pile fabric strips goes from the storage container or dispensing stand, through a seaming station and then to a fabric strip accumulating station. The path continues from the accumulating station to a winder station where the extended length knitted pile fabric strip is wound onto a core which is typically a hollow cylindrical cardboard or plastic take-up core. The extended length knitted pile fabric strips is wound to produce a spool of knitted pile fabric strip in which the extended length knitted pile fabric strip is spirally wound on the cylindrical take-up core with consecutive windings of the extended length knitted pile fabric strip being located close adjacent each other, and with consecutive rows of the extended length knitted pile fabric strip overlaying each other on the cylindrical take-up core.

The knitted pile fabric strips are unrolled and placed into the system of the present invention, passing first through the seaming station. The seaming station is used to quickly seam together the contiguous ends of consecutive knitted pile fabric strips. The small strip of seaming tape is activated by heat, with the abutting ends of consecutive knitted pile fabric strips being placed upside-down (so the backing is facing up) with the seaming tape being placed over the abutting ends. Pressure and heat is then applied by the seaming station to activate the seaming tape, thereby joining the consecutive knitted pile fabric strips together.

The extended length knitted pile fabric strip is then drawn into the accumulator station by a motorized roller drive which is actuated by an operator to draw the remaining portion of the extended length knitted pile fabric strips into the accumulator station. The motorized roller drive is located on the top of a slide which extends downwardly at an angle, ending in an accumulation bin. Located at a location near the bottom of the slide is a first photodetector, and located higher up the slide is a second photodetector.

As the motorized roller drive brings the extended length knitted pile fabric strip into the accumulator, the accumulator bin at the bottom of the slide will fill up first, following which the extended length knitted pile fabric strip will begin to accumulate on the slide itself, from the bottom upward. Until the extended length knitted pile fabric strip begins to accumulate in the slide, both the first and the second photodetector are unobstructed. As the slide begins to fill up after the accumulator bin is full, first the first photodetector and then the second photodetector will be obstructed. The photodetectors are used to operate the winder station.

The extended length knitted pile fabric strips travels from the accumulator station to the winder station, where it first passes over a series of rollers and then onto a guide arm which feeds the extended length knitted pile fabric strip onto the cylindrical take-up core onto which it is wound. A third photodetector is located on the guide arm to detect whether or not the extended length knitted pile fabric strip is present thereupon. The winder station has large circular discs located at each end of the cylindrical take-up core.

The lateral movement of the guide arm is controlled by a first servo drive, thus controlling the position on the cylindrical take-up core onto which the extended length knitted pile fabric strips is wound. The rotation of the cylindrical take-up core is controlled by a second servo drive. By controlling the first and second servo drives, the winding of the extended length knitted pile fabric strip onto the cylindrical take-up core can be precisely controlled to produce a tight winding in which the extended length knitted pile fabric strip is spirally wound onto the cylindrical take-up core with consecutive windings of the extended length knitted pile fabric strip being located close adjacent each other, and with consecutive rows of the extended length knitted pile fabric strip overlaying each other on the cylindrical take-up core.

Thus, by operating the winder station with a computer-controlled operating system, the movement of the first and second servo drives can be coordinated to produce the desired winding operation, taking into account the physical parameters of the extended length knitted pile fabric strip. Thus, the width and thickness of the extended length knitted pile fabric strip will determine the relative operation of the first and second servos. In addition, as progressive layers of the extended length knitted pile fabric strip are wound onto the cylindrical take-up core, the relative movements of the first and second servos will also have to be varied.

The overall speed of the winding operation is controlled by the three photodetectors. As long as both the first and second photodetectors in the accumulator are obstructed by the accumulated extended length knitted pile fabric strip, the winding operation will operate at high speed. When only the first photodetector is obstructed, the winding operation will occur at a lower speed. Whenever the third photodetector is not obstructed, the winding operation will immediately stop. In the preferred embodiment, the winding operation will only occur when an operator is feeding additional seamed-together knitted pile fabric strips into the accumulator, so the third photodetector should only be unobstructed when the winding operation is complete.

Following the completion of the winding operation onto a cylindrical take-up core, apparatus unrelated to the present invention would be used to secure the extended length knitted pile fabric strip roll. One end of the apparatus supporting the cylindrical take-up core will then be retracted, allowing the extended length knitted pile fabric strip roll to be removed from the winder station. The extended length knitted pile fabric strip roll may then be packaged for delivery in a box or in plastic film, and shipped to a paint roller manufacturer.

It may therefore be seen that the present invention teaches both a system and a method for the manufacture of knitted pile fabric strips of a substantially extended length for use by paint roller cover manufacturers in their manufacture of paint roller covers. The extended length knitted pile fabric strips of the present invention function as if they were one complete knitted pile fabric strip rather than a knitted pile fabric strip assembled from a plurality of shorter knitted pile fabric strips. The extended length knitted pile fabric strips of the present invention are supplied in an easy to use configuration which the paint roller cover manufacturers will find to be convenient in their manufacture of paint roller covers, without requiring any revision of their manufacturing processes or a substantial investment in new equipment.

The extended length knitted pile fabric strips of the present invention are manufacturable at little additional cost as compared to knitted pile fabric strips of conventional length. Further, the extended length knitted pile fabric strips of the present invention are packaged in a configuration which is convenient to ship despite the extended length of the extended length knitted pile fabric strips. This shipment configuration of the extended length knitted pile fabric strips of the present invention is as compact as possible to thereby require a minimized volume of packaging for shipment.

The apparatus used by the system and method of the present invention to manufacture the extended length knitted pile fabric strips is of a construction which is both durable and long lasting, and which will require little or no maintenance to be provided by the user throughout its operating lifetime. The system of the present invention used to manufacture the extended length knitted pile fabric strips and its cost of operation are relatively inexpensive, thereby affording the extended length knitted pile fabric strips of the present invention the broadest possible market and maximizing their market appeal. Finally, all of the aforesaid advantages and objectives of the extended length knitted pile fabric strips of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
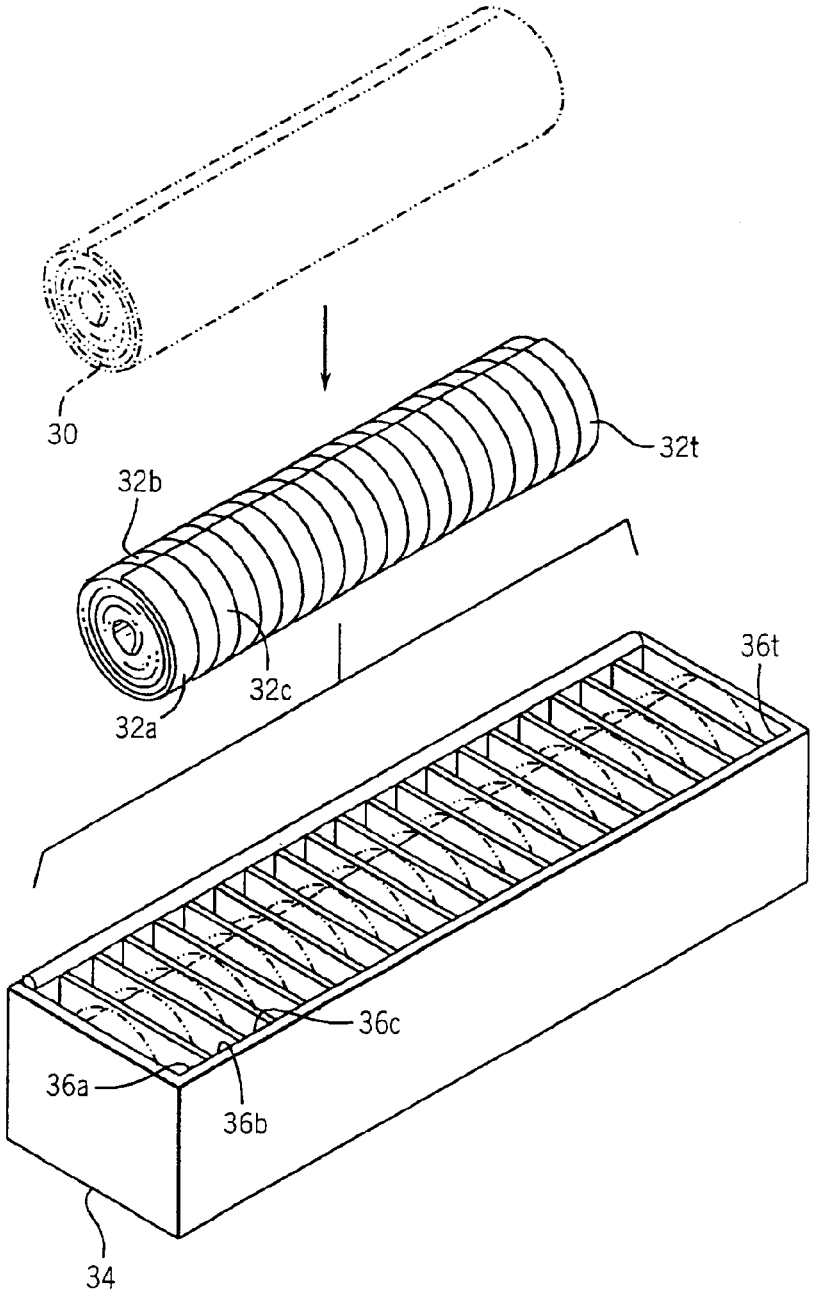
FIG. 1 is an exploded isometric view showing a roll of coated, sheared, knitted pile fabric segment (shown in phantom lines) which is slit to produce twenty rolls of strips of knitted pile fabric strips, which are stored in a segmented temporary storage container.

The preferred embodiment of the present invention involves manufacturing extended length knitted pile fabric strips from a plurality of standard length knitted pile fabric strips which are joined together at their respective contiguous ends. Referring first to FIG. 1, as the manufactured knit pile segment comes off of the manufacturing line, it is typically approximately sixty inches wide and between thirty and fifty yards long, and may be rolled into a single roll 30 as shown in phantom lines. More typically, as the manufactured knit pile segment comes off of the manufacturing line, it is slit into a plurality of two and seven-eighths inch wide strips, typically twenty such knitted pile fabric strips if the segment is approximately sixty inches wide. Preferably, all of the strips are wound onto a common axis, yielding twenty adjacent rolls of knitted pile fabric strips 32*a*, 32*b*, 32*c*, . . . and 32*t*.

For convenience, the twenty rolls of knitted pile fabric strips 32*a*, 32*b*, 32*c*, . . . and 32*t* may be temporarily stored in a segmented temporary storage container 34, which has twenty recesses 36*a*, 36*b*, 36*c*, . . . and 36*t* located therein for receiving the knitted pile fabric strips 32*a*, 32*b*, 32*c*, . . . and 32*t*, respectively. The segmented temporary storage container 34 represents a convenient way to transport the knitted pile fabric strips 32*a*, 32*b*, 32*c*, . . . and 32*t* from the point of their manufacture to the location at which a plurality of them will be combined to produce the extended length knitted pile fabric strip of the present invention. It will of course be appreciated by those skilled in the art that there are many other ways of transporting knitted pile fabric strips 32*a*, 32*b*, 32*c*, . . . and 32*t* to the desired location.

Figure 2:
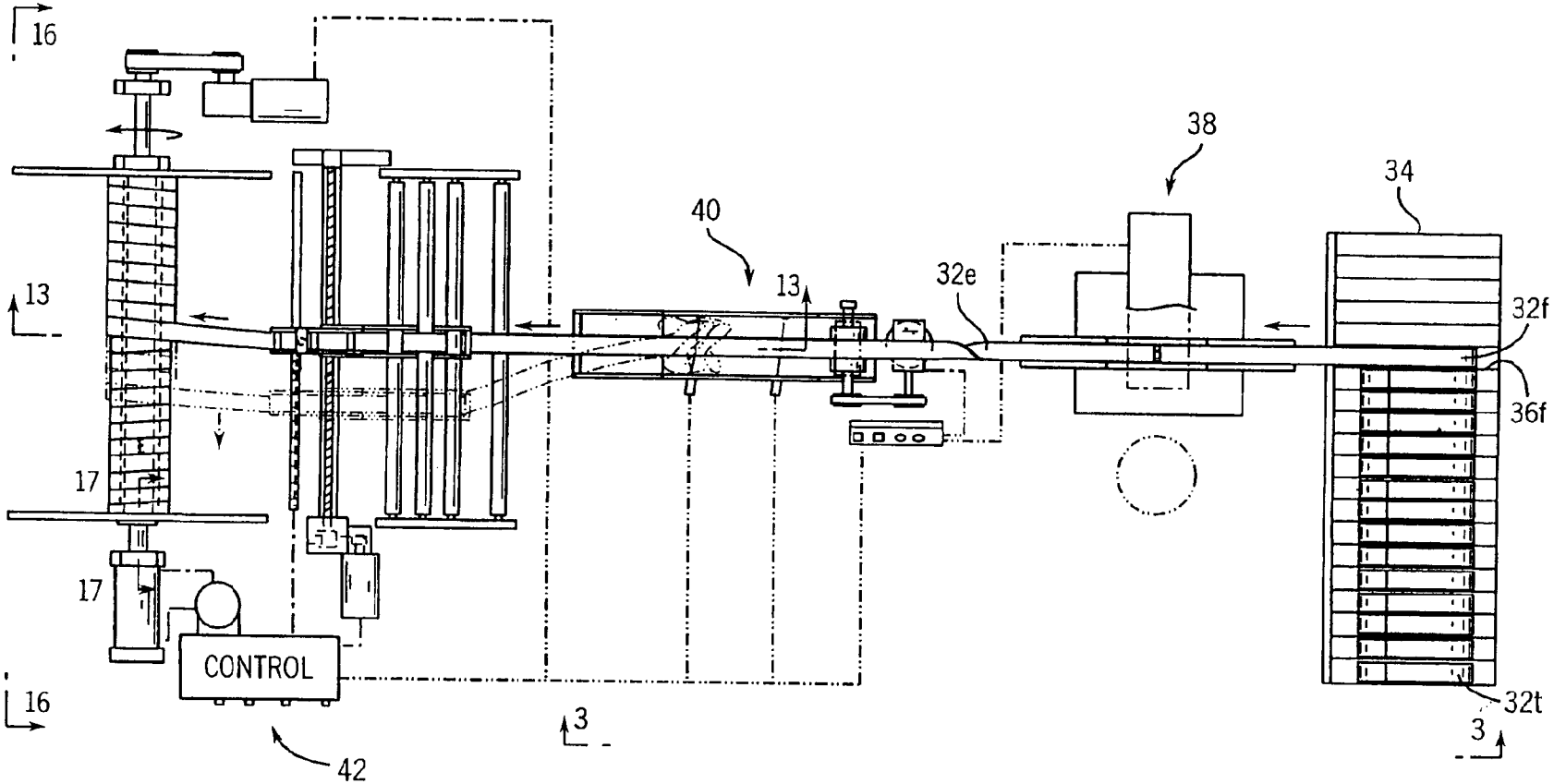
FIG. 2 is a top plan view of the preferred embodiment of a system for manufacturing the extended length knitted pile fabric strips of the present invention showing the path (from right to left) of the extended length knitted pile fabric strip from the segmented temporary storage container of FIG. 1 to a seamer station, then to a fabric strip accumulator station, and finally to a winder station.

Referring next to FIG. 2, the operation of the system and method of the present invention used to manufacture the extended length knitted pile fabric strips is illustrated in its entirety. The operation moves from right to left as viewed in FIG. 2, with the segmented temporary storage container 34 being located on the right to allow the knitted pile fabric strips 32*a*, 32*b*, 32*c*, . . . and 32*t* to be dispensed from it. From the segmented temporary storage container 34 the path of knitted pile fabric strips 32*a*, 32*b*, 32*c*, . . . and 32*t* is to a seaming station illustrated generally at 38, an accumulator station indicated generally at 40, and a winding station illustrated generally at 42.

Figure 3:
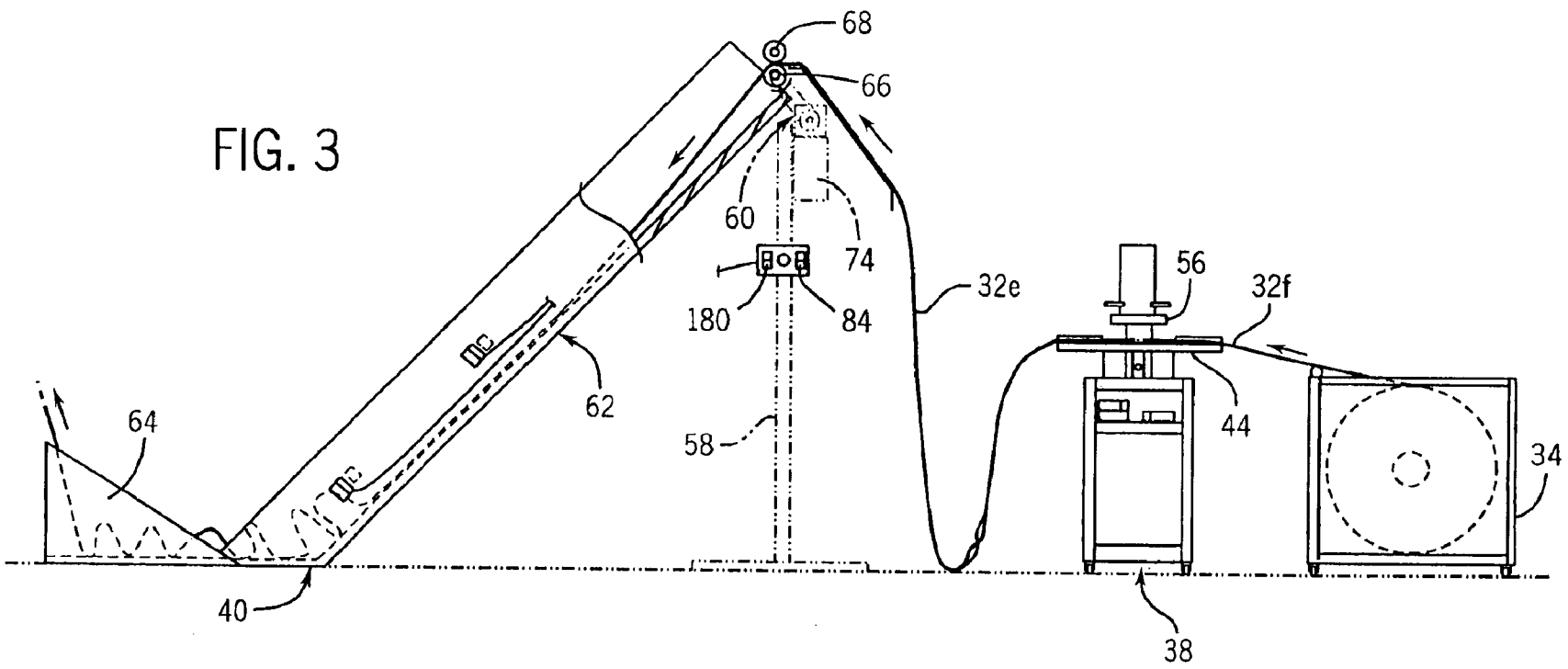
FIG. 3 is a side plan view of the segmented temporary storage container, the seamer station, and the fabric strip accumulator station illustrated in FIG. 2.

Referring now generally to FIGS. 2 and 3, and more particularly to FIGS. 4–7, the function and operation of the seaming station 38 will now be discussed. As best shown in FIGS. 2–5, the knitted pile fabric strips 32*a*, 32*b*, 32*c*, . . . and 32*t* are dispensed one at a time from the segmented temporary storage container 34, and pass through the seaming station 38. As each of the knitted pile fabric strips 32*a*, 32*b*, 32*c*, . . . and 32*t* comes to an end, the end of the particular knitted pile fabric strip (the knitted pile fabric strip 32*e* is shown in FIGS. 2 and 4–7), the beginning of another of the knitted pile fabric strips 32*a*, 32*b*, 32*c*, . . . and 32*t* (the knitted pile fabric strip 32*f* is shown in FIGS. 2 and 4–7) is taken from the segmented temporary storage container 34 and brought to the seaming station 38.

Figure 4:
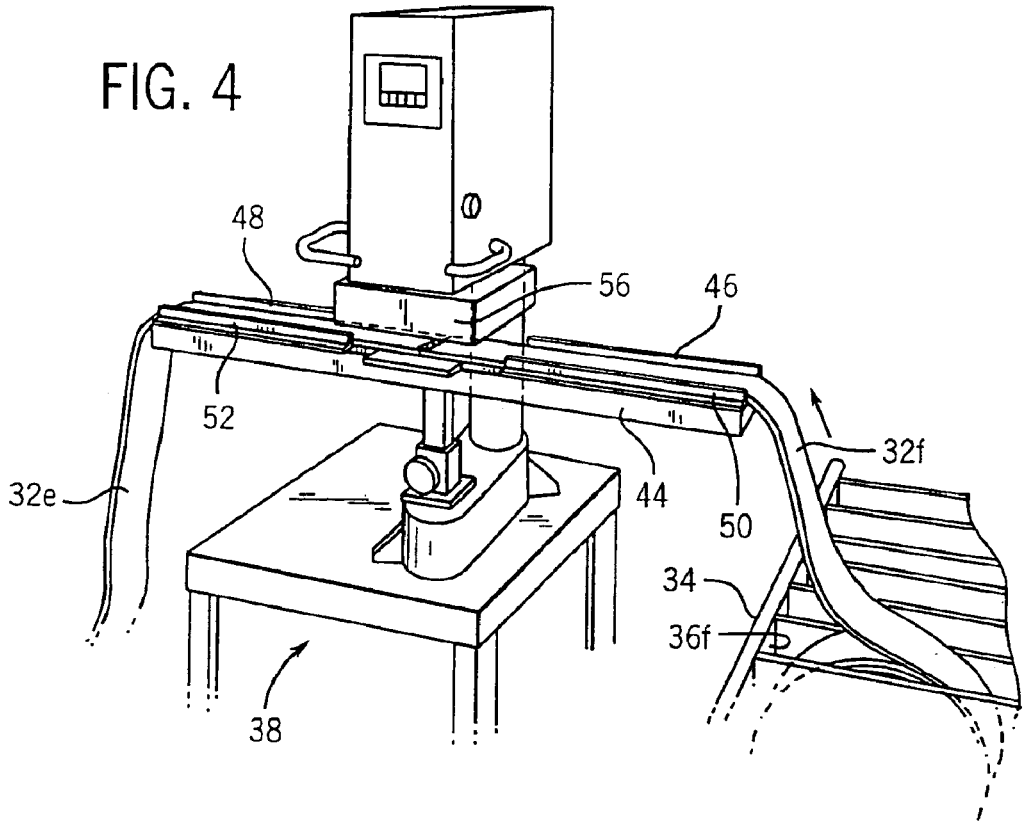
FIG. 4 is an isometric view of a portion of the segmented temporary storage container and the seamer station illustrated in FIG. 3 showing two knitted pile fabric strips with their adjacent ends abutting.
Figure 5:
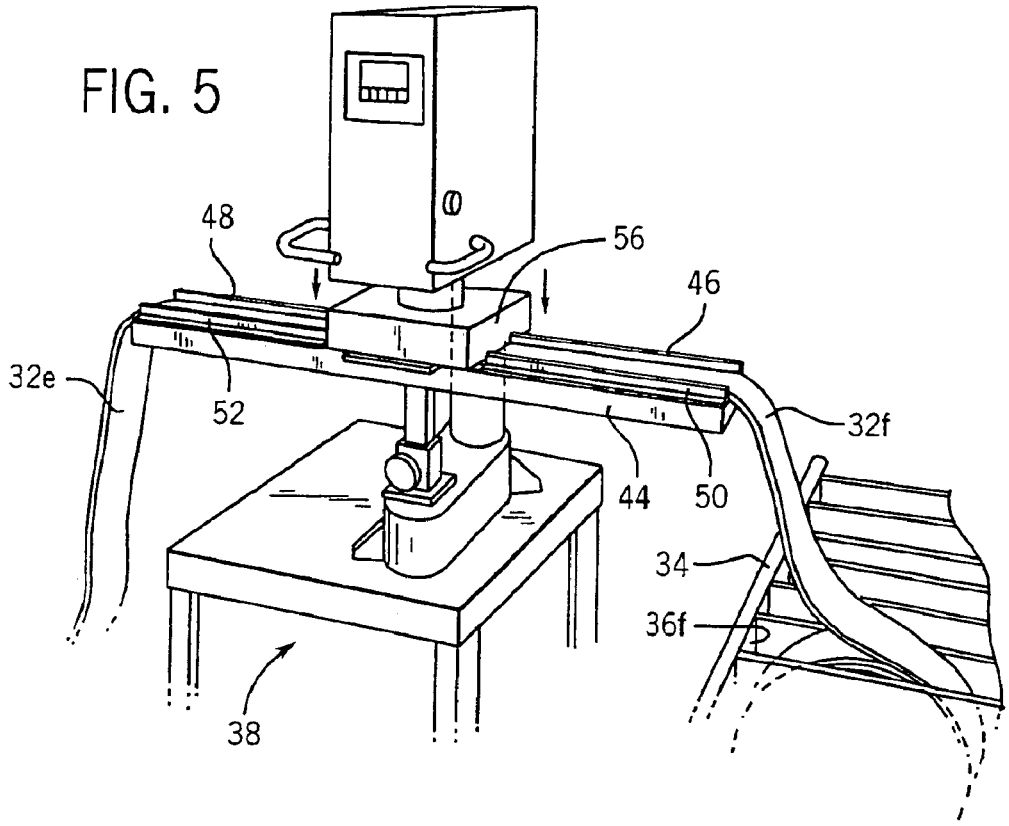
FIG. 5 is an isometric view similar to the view illustrated in FIG. 4, but with the seam being made on the seamer station.

Referring now particularly to FIGS. 4–7, the seaming operation is illustrated in some detail. The backing side of each of the knitted pile fabric strips 32*e* and 32*f* are facing upwardly, with the pile sides of the knitted pile fabric strips 32*e* and 32*f* facing down. The ends of the knitted pile fabric strips 32*e* and 32*f* are brought together in abutting fashion on a table 44 which is a part of the seaming station 38. As shown in FIGS. 4 and 5, the sides of the table 44 have guide segments 46 and 48 located at the rear edge of the table 44 at the right and left sides, respectively, and guide segments 50 and 52 located at the front edge of the table 44 at the right and left sides, respectively. The guide segments 46, 48, 50, and 52 are used to precisely align the knitted pile fabric strip 32*e* and 32*f* as they are attached together.

Figure 6:
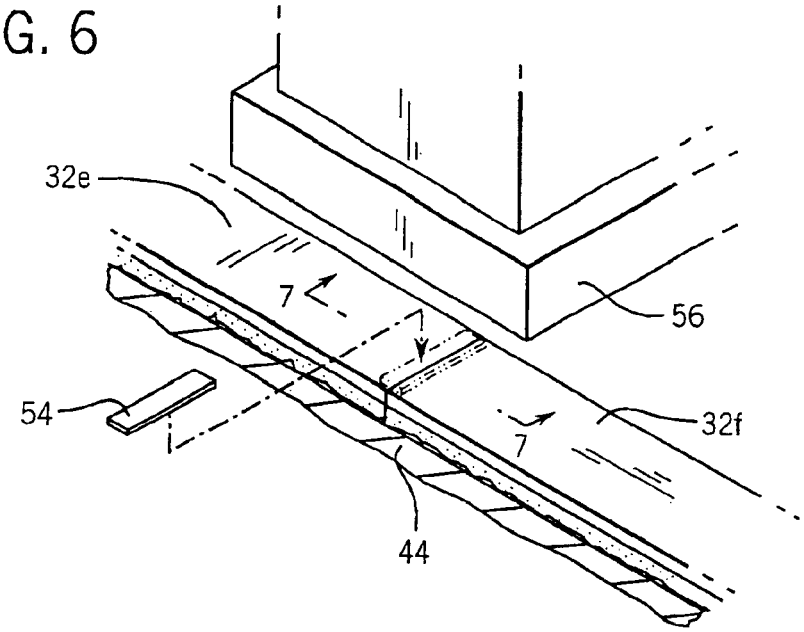
FIG. 6 is a close-up exploded view of a portion of the seamer station illustrated in FIG. 4, showing the placement of a strip of heat-activated seaming tape on the seam between the contiguous ends of two consecutive knitted pile fabric strips forming a part of the extended length knitted pile fabric strip.
Figure 7:
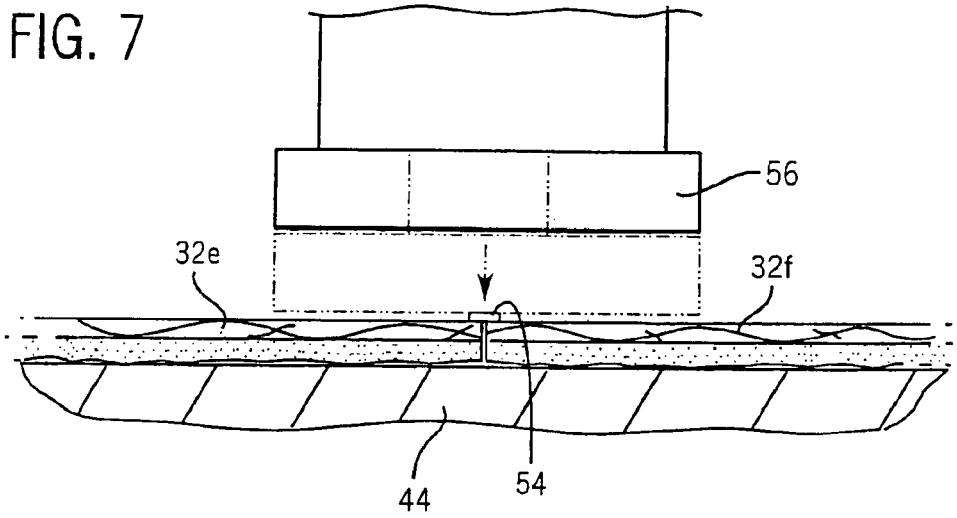
FIG. 7 is a side plan view similar to that illustrated in FIG. 6, showing the placement of the strip of heat-activated seaming tape on the seam between the contiguous ends of two consecutive knitted pile fabric strips forming a part of the extended length knitted pile fabric strip.

A strip of heat-activated seaming tape 54 is placed on the abutting ends of the knitted pile fabric strips 32*e* and 32*f* as best shown in FIGS. 6 and 7. It will be noted that the length of the strip of heat-activated seaming tape 54 is approximately the same as the width of the knitted pile fabric strip 32 (although it could be slightly shorter as well). An example of a material which may be used for the strip of heat-activated seaming tape 54 is Unimark Tape, which is a woven cloth thermal seaming tape manufactured by Unitherm, Inc. of Cincinnati, Ohio.

The strip of heat-activated seaming tape 54 is placed in position on the backing side of the knitted pile fabric strips 32*e* and 32*f*. The seaming operation is performed by pressing the strip of heat-activated seaming tape 54 and the adjacent ends of the knitted pile fabric strips 32*e* and 32*f* between a high temperature head 56 on the seaming station 38 and the table 44 of the seaming station 38 as shown in FIGS. 5 and 7. It will be noted from FIGS. 4 and 5 that the high temperature head 56 will fit between the ends of the guide segments 46 and 48 at the rear of the table 44 and between the guide segments 50 and 52 at the front of the table 44. In the preferred embodiment, it has been found that an optimal seaming operation is performed with the high temperature head 56 at approximately 400 degrees Fahrenheit for approximately three seconds. A bonding press which may be utilized by the seaming station 38 is the Model 907 Digital Automatic Flat Head Press, manufactured by Insta Graphic Systems, of Cerritos, Calif.

As portions of the knitted pile fabric strips pass through the seaming station 38, they are accumulated by the accumulator station 40, which is best shown in FIGS. 3 and 8–12. Following a seaming operation, the accumulator station 40 is used to draw and accumulate most of the length of the knitted pile fabric strip which has just been seamed onto the preceding knitted pile fabric strip to form an extended length knitted pile fabric strip. Thus, the accumulator station 40 has two major components—a drive system which upon actuation by an operator draws the knitted pile fabric strip from the segmented temporary storage container 34 (FIG. 3) into the accumulator station 40, and an accumulation area into which the knitted pile fabric strip is temporarily stored before it is drawn into the winding station 42 (shown in FIG. 2).

The major components of the accumulator station 40 are a stand 58, a roller drive system 60, a slide 62, and an accumulator bin 64. The roller drive system 60 is supported at the top of the stand 58. The slide 62 has one end thereof located near the top of the stand 58, and extends downwardly at an angle with its other end being located at the same level as the bottom of the stand 58. The details of the stand 58 are not significant, other than the fact that the stand 58 must function to support the roller drive system 60 and the one end of the slide 62 in fixed positions.

Figure 8:
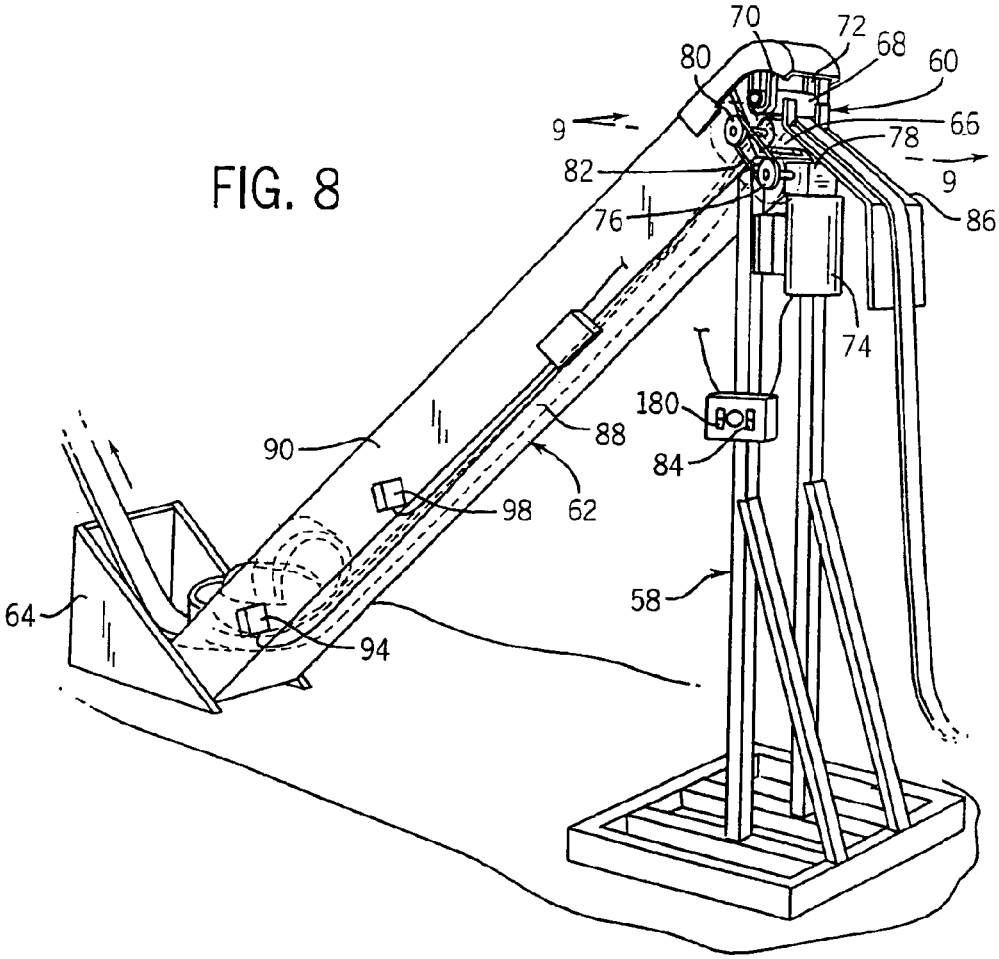
FIG. 8 is an isometric view of the accumulator station showing a motorized roller drive for drawing the extended length knitted pile fabric strip into the accumulator station, a slide having accumulation detectors located thereon, and an accumulation bin at the bottom of the slide.
Figure 9:
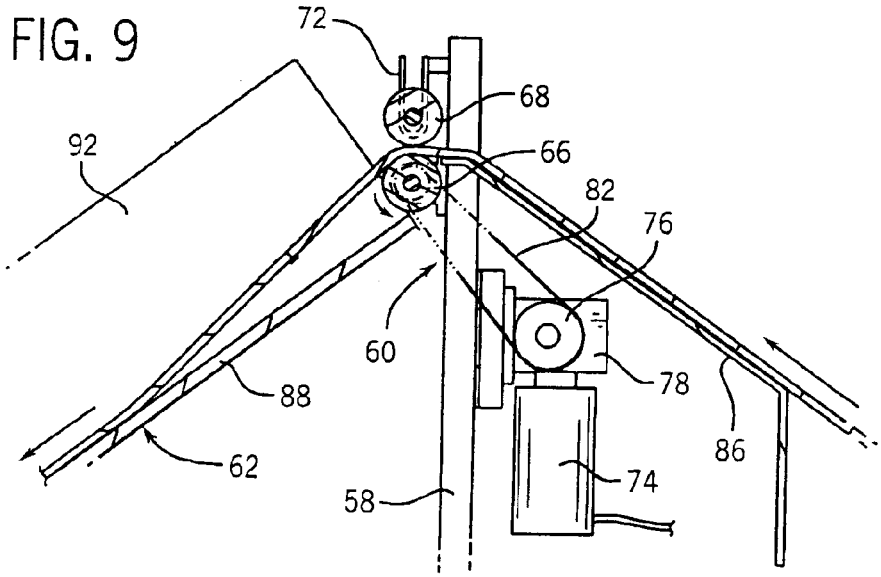
FIG. 9 is a side plan view of a portion of the accumulator station illustrated in FIG. 8 showing the motorized roller drive and the top of the slide.

The details of the roller drive system 60 are best shown in FIGS. 8 and 9. A drive roller 66 is rotatably mounted in a fixed horizontal position at the top of the slide 62. A driven roller 68 is located in a horizontal position above the drive roller 66, with the extended length knitted pile fabric strip passing between the drive roller 66 and the driven roller 68. The driven roller 68 may be mounted with its ends located in U-shaped channels 70 and 72 as shown, or in any other suitable manner. The U-shaped channels 70 and 72 allow the driven roller 68 to move up and down according to the thickness of the extended length knitted pile fabric strip passing between it and the drive roller 66. In the preferred embodiment, the drive roller 66 and the driven roller 68 are made of rubber, with the driven roller 68 having sufficient weight to maintain pressure exerted by it against the extended length knitted pile fabric strip and the drive roller 66.

The roller drive system 60 is operated by an electric motor 74, which drives a drive pulley 76 through a gear reduction system 78. The electric motor 74 and the gear reduction system 78 are mounted in the stand 58 below the top thereof. The drive pulley 76 drives a driven pulley 80 mounted on one end of the drive roller 66 with a belt 82.

The operation of the electric motor 74 is controlled by an accumulator control switch 84, which may be mounted on the side of the stand 58. Preferably, the accumulator control switch 84 is a single pole, single throw "on-off" switch which the operator turns on and off to control the operation of the electric motor 74. Located near the top of the stand 58 on the side thereof which faces the seaming station 38 is a guide member 86, which functions to guide the extended length knitted pile fabric strip to a location between the drive roller 66 and the driven roller 68.

The slide 62 is mounted onto the stand 58 with its upper end just below the drive roller 66, so that the extended length knitted pile fabric strip will be directed onto the surface of the slide 62 as it is drawn into the accumulator station 40 by the roller drive system 60. The slide 62 has a bottom surface 88 and upwardly extending side walls 90 and 92, which together form a U-shaped configuration which will guide the extended length knitted pile fabric strip down the slide 62. Located at the bottom of the slide 62 is the accumulator bin 64, which functions to store an accumulated portion of the length of the extended length knitted pile fabric strip.

Two photodetectors are located in the slide 62, with a first photodetector being located a short distance above the bottom of the slide 62 and a second photodetector being located nearly half way up the slide 62. Each of these two photodetectors consists of a light source and a light detector, with one of these elements for each photodetector being mounted in the slide side wall 90 and the other element of that photodetector being mounted in the slide side wall 92. The photodetectors are mounted approximately halfway up each of the slide side walls 90 and 92.

Thus, the first photodetector consists of a light source 94 mounted in the slide side wall 90 and a light detector 96 mounted in the slide side wall 92 directly opposite the light source 94. Similarly, the second photodetector consists of a light source 98 mounted in the slide side wall 90 and a light detector 100 mounted in the slide side wall 92 directly opposite the light source 94. The light sources 94 and 98 are oriented to direct light onto the light detectors 96 and 100, respectively, and the light detectors 96 and 100 are oriented to detect light directed onto them from the light sources 94 and 98, respectively.

Figure 12:
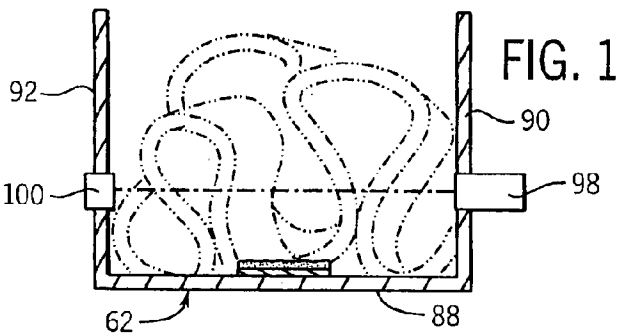
FIG. 12 is a cross-sectional view of the slide illustrated in FIG. 11 at the location of the upper photodetector, showing how portions of the accumulated extended length knitted pile fabric strip obstruct the upper photodetector in the slide.

Note that the first and second photodetectors are located sufficiently high enough in the slide 62 so that they will not be obstructed by the extended length knitted pile fabric strip unless and until it begins to accumulate in the slide 62 itself, as best shown in FIG. 12. Due to the pitch of the slide 62, the extended length knitted pile fabric strip will not begin to accumulate in the slide 62 until the accumulator bin 64 is full, at which time the extended length knitted pile fabric strip will begin to accumulate in the slide 62, from the bottom upwards.

Figure 10:
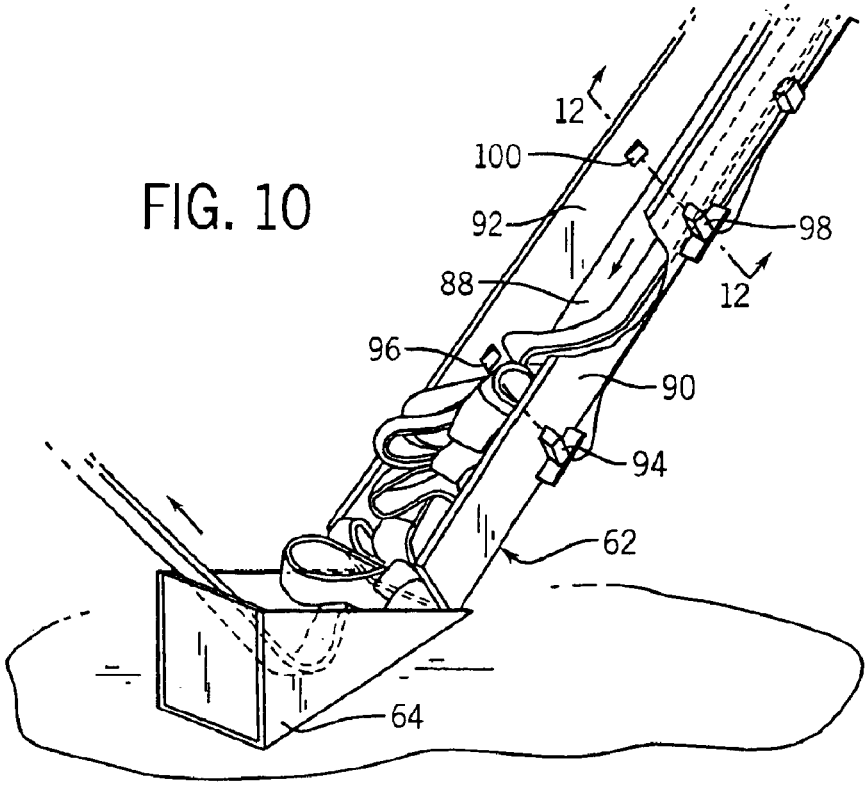
FIG. 10 is an isometric view of the accumulator station illustrated in FIG. 8 showing the lower portion of the slide and the accumulation bin at the bottom of the slide, and also showing two photodetector transmitters and receivers located in the slide at two locations, with portions of the accumulated extended length knitted pile fabric strip shown as obstructing the lower photodetector in the slide.
Figure 11:
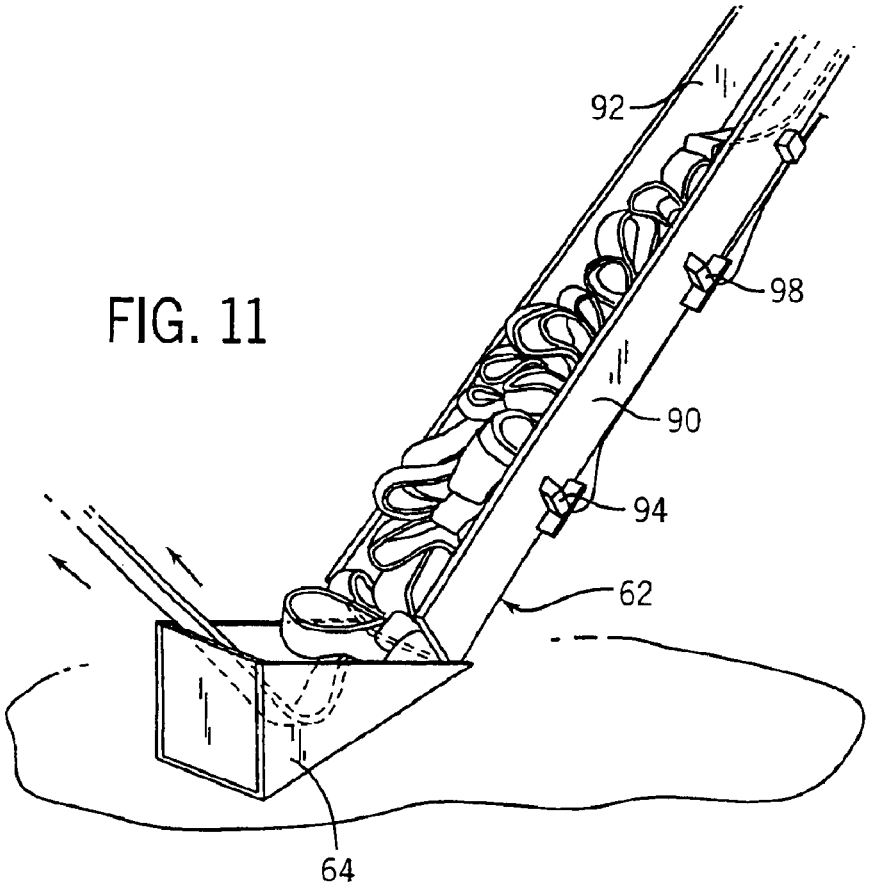
FIG. 11 is an isometric view similar to that illustrated in FIG. 10, but with portions of the accumulated extended length knitted pile fabric strip shown as obstructing both the lower and upper photodetectors in the slide.
Figure 13:
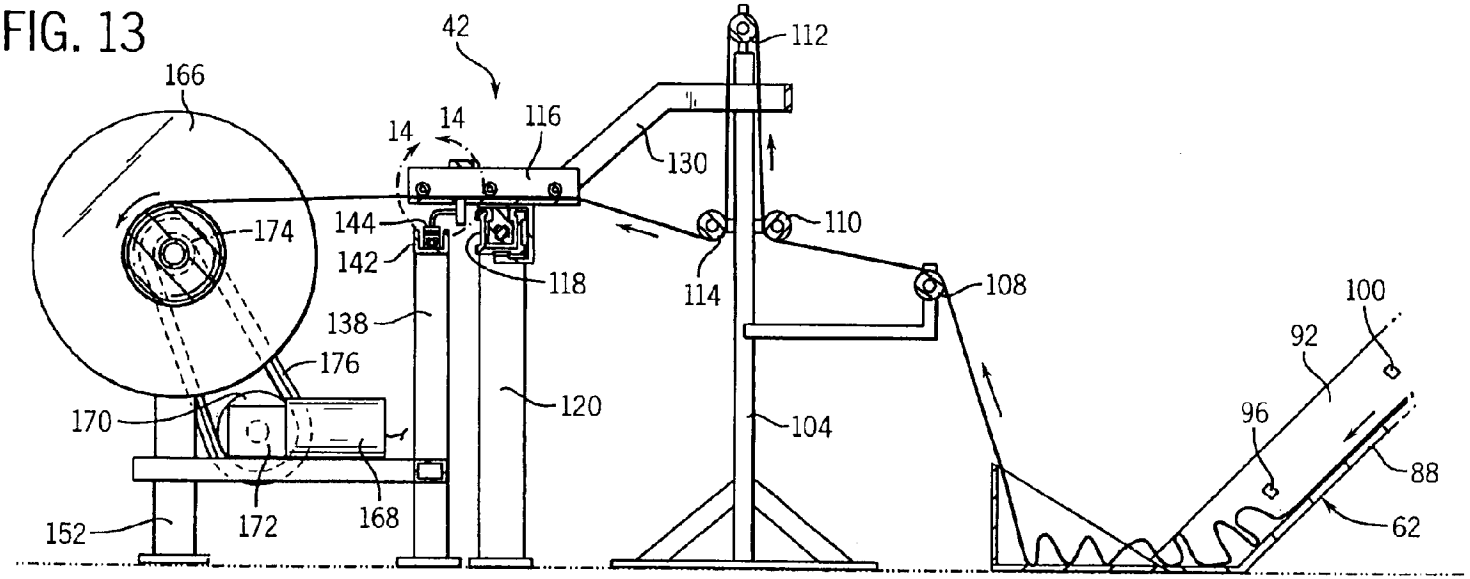
FIG. 13 is a side plan view of the lower portion of the slide, the accumulation bin at the bottom of the slide, and the winder station illustrated in FIG. 2, showing both the lower and upper photodetectors to be unobstructed.

Thus, as the extended length knitted pile fabric strip is accumulated in the accumulator station 40, the accumulator bin 64 will fill up first, as shown in FIG. 13, in which the accumulator bin 64 is essentially full and the extended length knitted pile fabric strips is just beginning to accumulate in the bottom of the slide 62. As the extended length knitted pile fabric strip continues to accumulate, it will accumulate up to the first photodetector, blocking light emitted from the light source 94 from reaching the light detector 98, as shown in FIG. 10. As even more of the extended length knitted pile fabric strip accumulates, it will accumulate up to the second photodetector, blocking light emitted from the light source 98 from reaching the light detector 100, as shown in FIG. 11.

The purpose of the first and second photodetectors is thus to detect how much of the extended length knitted pile fabric strip is located in the accumulator station 40. The system and method of the present invention use this information to control the operation of the winding station 42, by varying the speed at which the winding station 42 operates according to how much of the extended length knitted pile fabric strip is located in the accumulator station 40 and thus is available to the winding station 42. This will be described in greater detail below, in conjunction with a description of the operation of the system and method of the present invention.

Referring next to FIGS. 13 through 18, the winding station 42 is illustrated in detail. The function of the winding station 42 is to wind the extended length knitted pile fabric strip onto a cylindrical take-up core 102 (shown in FIGS. 17 and 18), particularly in a highly efficient and compact fashion. The winding station 42 thus performs three functions which are all directed toward winding the extended length knitted pile fabric strip onto the take-up core in the desired manner. The first function is a pre-tensioning of the extended length knitted pile fabric strip, the second function is controlling the lateral position at which the extended length knitted pile fabric strip is wound onto the take-up core, and the third function is controlling the rotation of the take-up core as the extended length knitted pile fabric strip is wound onto it.

Figure 15:
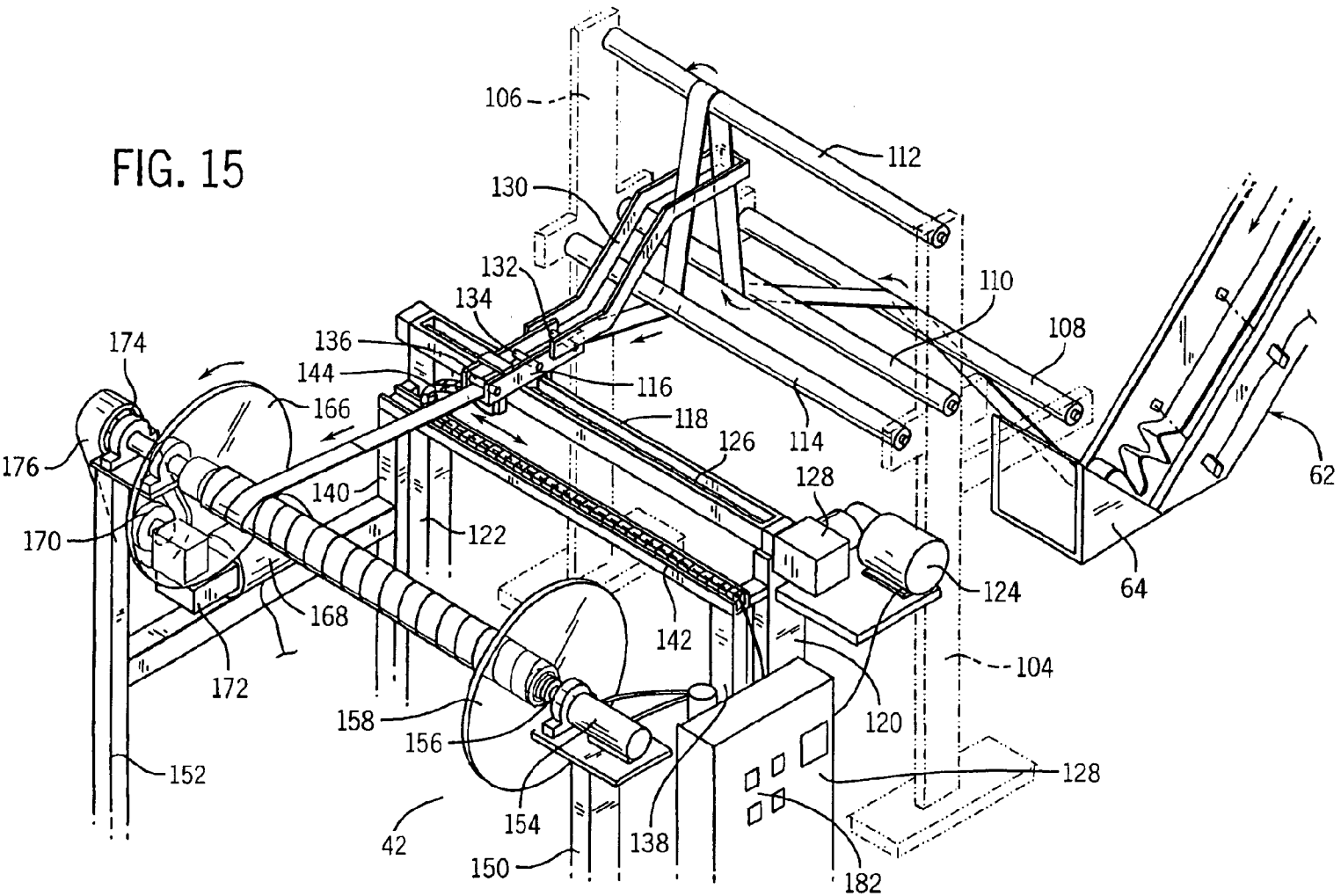
FIG. 15 is an isometric view similar of the lower portion of the slide, the accumulation bin at the bottom of the slide, and the winder station illustrated in FIG. 13, showing the extended length knitted pile fabric strip being wound onto a cylindrical take-up core mounted between two discs.
Figure 16:
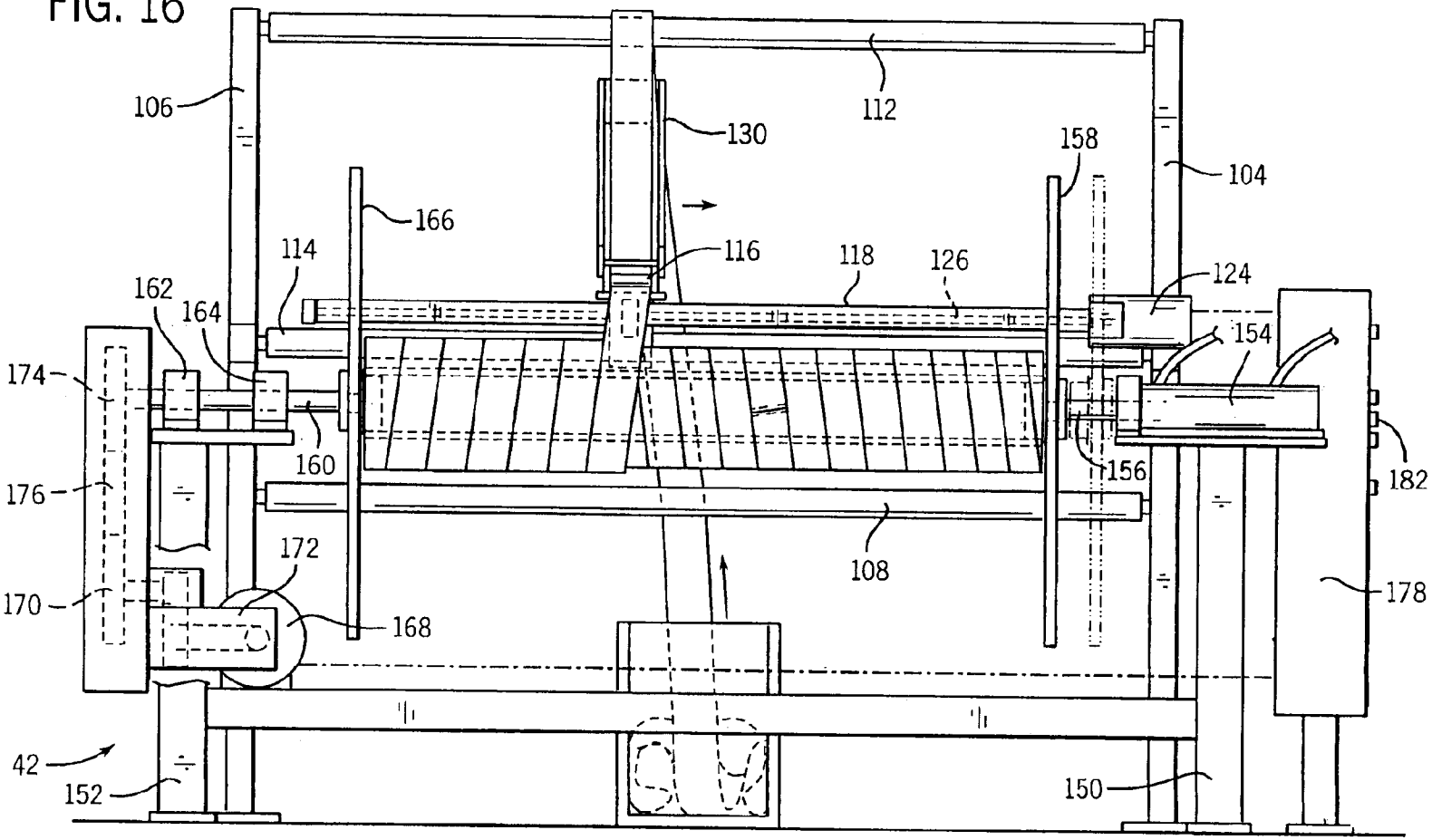
FIG. 16 is a front plan view of the winder station illustrated in FIGS. 13 and 15, showing how one of the discs and support apparatus retaining one side of the cylindrical take-up core can be retracted to remove the cylindrical take-up core from the winder station when the cylindrical take-up core is full.

The pretensioning function is performed by four rollers which are all mounted parallel to each other. Referring particularly to FIGS. 13 and 15, first and second roller support structures 104 and 106 are used to support four rollers 108, 110, 112, and 114. The first and second roller support structures 104 and 106 are located on the side of the winding station 42 facing the accumulator station 40.

The rollers 110 and 112 are spaced apart and are located on opposite sides of the first and second roller support structures 104 and 106, approximately sixty percent of the height of the first and second roller support structures 104 and 106. The roller 110 is located on the side of the first and second roller support structures 104 and 106 facing the accumulator station 40, and the roller 112 is located on the opposite side of the first and second roller support structures 104 and 106. The roller 108 is mounted so that it is spaced away from the first and second roller support structures 104 and 106, and is located slightly lower than the level of the rollers 110 and 114. The roller 112 is centrally located at the top of the first and second roller support structures 104 and 106.

The path of the extended length knitted pile fabric strip leads from the accumulator bin 64 in the accumulator station 40 onto the top of the roller 108, and then under the roller 110, over the top of the roller 112, and under the roller 114. From the roller 114, the extended length knitted pile fabric strip enters the mechanism which controls the lateral position at which the extended length knitted pile fabric strip is wound onto the take-up core. It will thus be appreciated by those skilled in the art that the four rollers 108, 110, 112, and 114 perform a pre-tensioning of the extended length knitted pile fabric strip at it passes therethrough.

Figure 17:
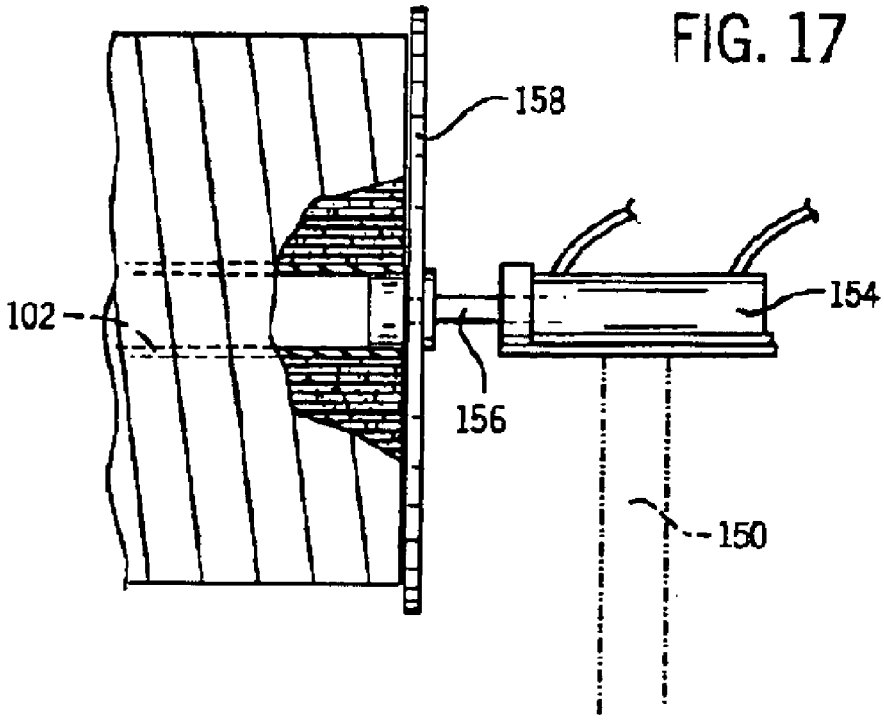
FIG. 17 is a plan view of a portion of a full cylindrical take-up core and how it is engaged by one of the discs and the support apparatus.
Figure 18:
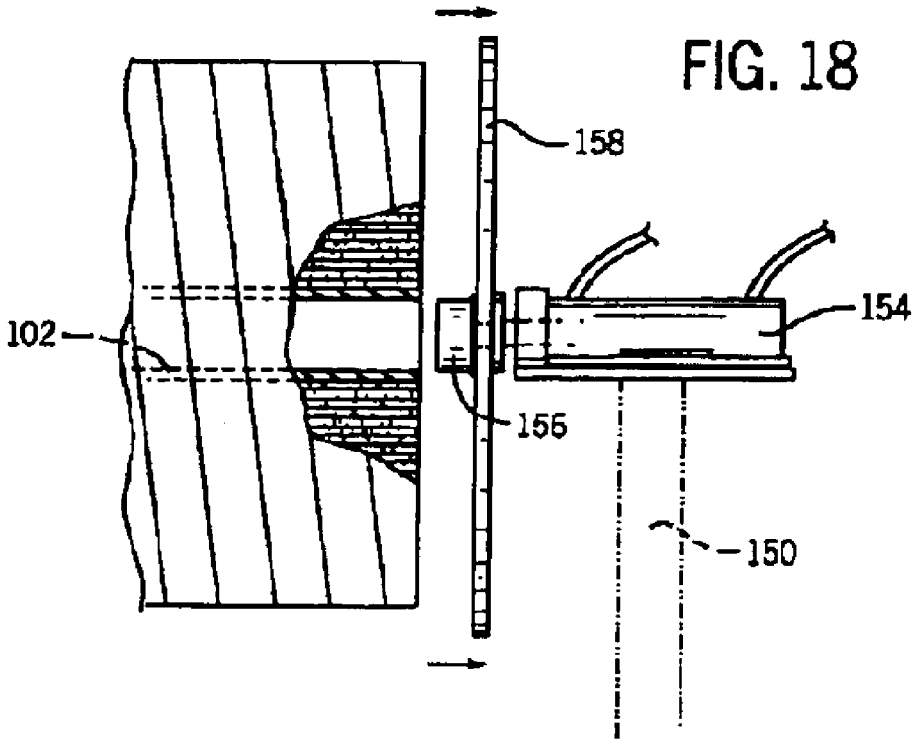
FIG. 18 is a plan view similar to that illustrated in FIG. 17, but with the disc and the support apparatus retracted to allow the full cylindrical take-up core to be removed from the winder station.

The next portion of the winding station 42 is the mechanism which controls the lateral position at which the extended length knitted pile fabric strip is wound onto the take-up core 102 (FIGS. 17 and 18). This function is accomplished by providing a strip guide carriage 116 which is driven laterally on a track member 118 which is supported at the top of two track support members 120 and 122 in a position at approximately the same height as the roller 114. It may be seen that the track member 118 is open on the top side thereof, thereby defining a U-shaped cross section, with a portion of the strip guide carriage 116 extending down into the interior of the U. The track member 118 is mounted in a position which is parallel to the four rollers 108, 110, 112, and 114.

A servo motor 124 drives a drive screw 126 through a gear reduction system 128, with the servo motor 124 and the gear reduction system 128 being mounted on the track support member 120. The drive screw 126 extends through a portion of the strip guide carriage 116 to thereby drive it laterally back and forth on the track member 118 as the drive screw 126 rotates. The servo motor 124 is highly precise in its operation, and can be driven to precisely position the strip guide carriage 116 on the track member 118, and may provide a feedback signal to indicate where the strip guide carriage 116 is on the track member 118 at any given time.

Mounted onto and extending from the strip guide carriage 116 is an irregular guide member 130 which extends around the portions of the extended length knitted pile fabric strip which extend between the roller 110 and the roller 112, and between the roller 112 and the roller 114. When viewed from above, the irregular guide member 130 will appear to have a highly extended U-shape. When viewed from the side, it may be seen that the irregular guide member 130 extends upwardly as it moves away from the strip guide carriage 116 toward the segments of the extended length knitted pile fabric strip which it guides, guiding them at a location nearer the roller 112 than the rollers 110 and 114.

It may also be seen that the width of the irregular guide member 130 is such that it accommodates the width of the extended length knitted pile fabric strip therein. As the irregular guide member 130 is moved laterally with movement of the strip guide carriage 116 on the track member 118, the irregular guide member 130 will tend to guide the extended length knitted pile fabric strip to move laterally on the rollers 108, 110, 112, and 114. Looking more closely at the strip guide carriage 116 itself, it may be seen that it has an internal width which closely accommodates and guides the extended length knitted pile fabric strip therein. The upper surface of the strip guide carriage 116 presents a U-shaped configuration with the extended length knitted pile fabric strip being accommodated within the U.

Located in the strip guide carriage 116 and extending between its lateral sides at locations spaced away from the bottom of the U are three guide rollers 132, 134, and 136. From the detailed view of FIG. 14, it may be seen that the extended length knitted pile fabric strip passes under the guide rollers 132, 134, and 136 on the bottom of the U formed in the top of the strip guide carriage 116. Thus, as the strip guide carriage 116 moves laterally on the track member 118, it will serve to control the lateral position at which the extended length knitted pile fabric strip is wound onto the take-up core 102 (FIGS. 17 and 18).

Located on the side of the track support members 120 and 122 opposite the accumulator station 40 are two channel support members 138 and 140 which support a U-shaped channel 142 which is located slightly lower than the track member 118. The U-shaped channel 142 is mounted parallel to the track member 118 with its open side facing upwardly. Located in the U-shaped channel 142 is a flexible wiring guide 144 which has one end fastened to the strip guide carriage 116. The flexible wiring guide 144 carries wiring to the strip guide carriage 116 for use with a third photodetector carried by the strip guide carriage 116.

Figure 14:
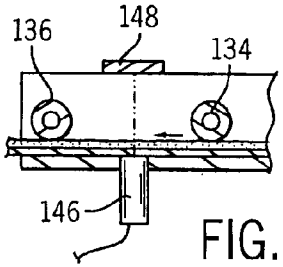
FIG. 14 is an enlarged view of a portion of the winder station showing a photodetector used to detect the presence or absence of the extended length knitted pile fabric strip available for winding.

The third photodetector consists of a light source 146 and a light detector 148 both mounted onto the strip guide carriage 116, as shown in FIG. 14. The light source 146 is mounted in the bottom of the strip guide carriage 116 and the light detector 148 is mounted in the top of the strip guide carriage 116. The light source 146 is oriented to direct light onto the light detector 148, and the light detector 148 is oriented to detect light directed onto it from the light source 146. It may be seen that the third photodetector will function to detect the presence or absence of the extended length knitted pile fabric strip in the strip guide carriage 116.

The next portion of the winding station 42 is the mechanism which controls the rotation of the take-up core 102 as the extended length knitted pile fabric strip is wound onto it. This function is accomplished by removably supporting the take-up core and rotating it to wind the extended length knitted pile fabric strip thereupon. Located at the end of the winding station 42 opposite the accumulator station 40 are two winder support members 150 and 152 which are used to support the take-up core 102, the mechanism rotating it, and the mechanism releasably retaining it.

Referring now to FIGS. 13 and 15–18, located on top of the winder support member 150 is a hydraulic support member 154 having a rotatable core support member 156 extending therefrom. The distal end of the core support member 156 has an end disc 158 mounted thereupon at a location near the end thereof, and a distal portion which is configured and arranged to fit closely within an end of the take-up core 102 (as best shown in FIGS. 17 and 18). It may be seen that the core support member 156 may be extended (as shown in FIG. 17) to retain the take-up core 102 in position in the winding station 42 or retracted (as shown in FIG. 18) to allow a full take-up core 102 to be removed and an empty take-up core 102 to be installed.

The other end of the take-up core 102 is supported by a core support member 160 which is rotatably mounted on the winder support member 152 using bearing mounts 162 and 164. The distal end of the core support member 160 has an end disc 166 mounted thereupon at a location near the end thereof, and a distal portion (not shown) which is identical to that of the core support member 156 (shown in FIG. 18) and is configured and arranged to fit closely within an end of the take-up core 102.

The take-up core 102 is rotated by a servo motor 168, which drives a drive pulley 170 through a gear reduction system 172. The servo motor 168 and the gear reduction system 172 are mounted on the winder support member 152. The drive pulley 170 drives a driven pulley 174 mounted on an end of the core support member 160 with a belt 176. The servo motor 168 is highly precise in its operation, and can be driven to precisely rotate the take-up core 102, and may provide a feedback signal to indicate the rotational position of the take-up core 102 is at any given time since beginning to wind the extended length knitted pile fabric strip on the take-up core 102.

Completing the construction of the winding station 42 is a control system 178 which is mounted on the channel support member 138. The control system 178 is used to control the operation of the winding station 42, and has as inputs the first and second photodetectors on the accumulator station 40, a winder control switch 180 (shown in FIG. 3 mounted near the accumulator control switch 84) which allows an operator to stop the winding process on the winding station 42, the third photodetector on the winding station 42, and winding process selection elements 182 which are located on the control system 178.

The operation of the winding station 42 to wind the extended length knitted pile fabric strip onto the take-up core 102 may now be explained briefly in a manner which will at once be understood by those skilled in the art. By using the winding process selection elements 182 to enter into the control system 178 parameters such as the physical characteristics of the extended length knitted pile fabric strip being wound, the control system 178 will properly control the winding process. The most important of these characteristics relates to the thickness of the extended length knitted pile fabric strip, since the width is standard. The winding process selection elements 182 can be set up to allow the selection of a particular weight or style of the extended length knitted pile fabric strip being wound, to indicate the start of the winding of a new take-up core 102, or other parameters which will provide the same information (a style number or name, for example).

The other factor is where the winding is started (i.e., where the strip guide carriage 116 is when the winding process begins). It may be desirable to start with the strip guide carriage 116 guiding the extended length knitted pile fabric strip onto the take-up core 102 at an end thereof, but the control system 178 can also operate even if the winding is started in the center of the take-up core 102. This is so because the winding process basically involves a mathematically-based control which is designed to ensure that the extended length knitted pile fabric strip is spirally wound onto the cylindrical take-up core 102 with consecutive windings of the extended length knitted pile fabric strip being located close adjacent each other, and with consecutive rows of the extended length knitted pile fabric strip overlaying each other on the cylindrical take-up core 102.

Then, by using the control system 178 to automatically control the operation of the servo motor 124 and the servo motor 168, the winding operation can be precisely controlled. Since the control system 178 will always know where the winding process is, the servo motor 124 and the servo motor 168 can be operated to control the lateral position of the extended length knitted pile fabric strip as it is wound onto the take-up core 102 to ensure that it is spirally wound with consecutive windings of the extended length knitted pile fabric strip being located close adjacent each other and with consecutive rows of the extended length knitted pile fabric strip overlaying each other, the spacing between rotations being mathematically determined based on the inputs supplied by the winding process selection elements 182.

The speed of the winding operation is affected by the inputs from the first and second photodetectors in the accumulator station 40. If the inputs from them indicate that both the first and second photodetectors are blocked (indicating the presence of the extended length knitted pile fabric strip in the accumulator bin 64 and up the slide 62 to the level of the second photodetector), the winding operation will proceed at its fastest speed. If the inputs from the first and second photodetectors indicates that only the first photodetector is blocked (indicating the presence of the extended length knitted pile fabric strip in the accumulator bin 64 and only at the lower portion of the slide 62), the winding operation will proceed at a medium speed.

If the inputs from the first and second photodetectors indicates that neither the first photodetector is blocked (indicating a diminished supply of the extended length knitted pile fabric strip in the accumulator bin 64 only), the winding operation will proceed at a slow speed. The operator of the system can stop the winding operation by using the winder control switch 180 on the accumulator station 40 at any time. Thus, when the operator is going to take a break and will not be seaming additional segments of knitted pile fabric strips, the winding operation will be stopped. When the end of the extended length knitted pile fabric strip is reached, the winding operation will proceed at the slow speed until the extended length knitted pile fabric strip moves through the third photodetector; when the third photodetector is not blocked, the winding operation will be finished.

It may therefore be appreciated from the above detailed description of the preferred embodiment of the present invention that it teaches both a system and a method for the manufacture of knitted pile fabric strips of a substantially extended length for use by paint roller cover manufacturers in their manufacture of paint roller covers. The extended length knitted pile fabric strips of the present invention function as if they were one complete knitted pile fabric strip rather than a knitted pile fabric strip assembled from a plurality of shorter knitted pile fabric strips. The extended length knitted pile fabric strips of the present invention are supplied in an easy to use configuration which the paint roller cover manufacturers will find to be convenient in their manufacture of paint roller covers, without requiring any revision of their manufacturing processes or a substantial investment in new equipment.

The extended length knitted pile fabric strips of the present invention are manufacturable at little additional cost as compared to knitted pile fabric strips of conventional length. Further, the extended length knitted pile fabric strips of the present invention are packaged in a configuration which is convenient to ship despite the extended length of the extended length knitted pile fabric strips. This shipment configuration of the extended length knitted pile fabric strips of the present invention is as compact as possible to thereby require a minimized volume of packaging for shipment.

The apparatus used by the system and method of the present invention to manufacture the extended length knitted pile fabric strips is of a construction which is both durable and long lasting, and which will require little or no maintenance to be provided by the user throughout its operating lifetime. The system of the present invention used to manufacture the extended length knitted pile fabric strips and its cost of operation are relatively inexpensive, thereby affording the extended length knitted pile fabric strips of the present invention the broadest possible market and maximizing their market appeal. Finally, all of the aforesaid advantages and objectives of the extended length knitted pile fabric strips of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A roll of knitted pile fabric, comprising:

a take-up core member, said take up core having a first end and a second end; and an extended length fabric strip forming a plurality of consecutive rows of said extended length fabric strip overlaying each other on said take-up core member, each of said rows of said extended length fabric strip comprising a plurality of consecutive windings contiguously wrapped around said take-up core member between said first and second ends of said take-up core member.

2. A roll of knitted pile fabric as defined in claim 1, wherein said extended length fabric strip comprises a plurality of knitted pile fabric strips each having opposite ends, said fabric strips being joined together at their respective ends to produce said extended length fabric strip.

3. A roll of knitted pile fabric as defined in claim 2, wherein said extended length fabric strip comprises between three and ten of said knitted pile fabric strips.

4. A roll of knitted pile fabric as defined in claim 2, wherein said fabric strips each have opposite pile and backing sides and are joined together at their respective ends on said backing sides thereof.

5. A roll of knitted pile fabric as defined in claim 4, wherein said respective ends of said fabric strips are joined together using a heat-activated seaming tape on said backing sides.

6. A roll of knitted pile fabric as defined in claim 1, wherein said take-up core member is made of either cardboard or plastic.

7. A roll of knitted pile fabric as defined in claim 6, wherein said take-up core member is cylindrical and hollow.

8. A roll of knitted pile fabric as defined in claim 1, wherein said consecutive windings are substantially spirally wound around said take-up core member.

9. A spool of extended length knitted pile fabric, comprising:

a cylindrical take-up core member; and a plurality of knitted pile fabric strips each having opposite ends, said fabric strips being contiguously joined together at their respective ends to produce an extended length fabric strip, said extended length fabric strip forming a plurality of consecutive rows of said extended length fabric strip overlaying each other on said take-up core member, each of said rows of said extended length fabric strip comprising a plurality of consecutive windings contiguously wrapped around said take-up core member between said first and second ends of said take-up core member.

10. A spool of extended length knitted pile fabric as defined in claim 9, wherein said fabric strips each have opposite pile and backing sides and are joined together at their respective ends on said backing sides thereof.

11. A spool of extended length knitted pile fabric as defined in claim 10, wherein said respective ends of said fabric strips are joined together using a heat-activated seaming tape on said backing sides.

12. A roll of knitted pile fabric as defined in claim 9, wherein said extended length fabric strip comprises between three and ten of said knitted pile fabric strips.

13. A spool of extended length knitted pile fabric as defined in claim 9, wherein said take-up core member is made of either cardboard or plastic.

14. A spool of extended length knitted pile fabric as defined in claim 9, wherein said consecutive windings are substantially spirally wound around said take-up core member.

15. A roll of extended length pile fabric, said roll comprising:

a spool member comprising a cylindrical core, said spool member having first and second ends; and an extended length pile fabric strip which is substantially spirally wound onto said spool member, wherein said extended length fabric strip forms a plurality of consecutive rows of said extended length fabric strip overlaying each other on said spool member, each of said rows of said extended length fabric strip comprising a plurality of consecutive windings located close adjacent to each other on said spool member.

16. A roll as defined in claim 15, wherein said extended length fabric strip is formed by joining a plurality of knitted pile fabric strips together at their respective ends to produce said extended length fabric strip.

17. A roll as defined in claim 16, wherein said fabric strips each have opposite pile and backing sides and are joined together at their respective ends.

18. A roll as defined in claim 17, wherein said respective ends of said fabric strips are joined together using a heat-activated seaming tape on said backing sides.

19. A roll of knitted pile fabric as defined in claim 15, wherein said extended length fabric strip comprises between three and ten of said knitted pile fabric strips.

20. A roll as defined in claim 15, wherein said spool member is made of cardboard or plastic.

21. A roll as defined in claim 15, wherein said spool member is cylindrical.

* * * * *